US009058788B2

(12) United States Patent
Kay et al.

(10) Patent No.: US 9,058,788 B2
(45) Date of Patent: Jun. 16, 2015

(54) APPARATUS, DISPLAY DEVICE, AND METHOD THEREOF FOR PROCESSING IMAGE DATA FOR DISPLAY BY A DISPLAY PANEL

(75) Inventors: Andrew Kay, Oxford (GB); Allan Evans, Oxford (GB); Benjamin John Broughton, Oxford (GB); Kenji Maeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 476 days.

(21) Appl. No.: 13/393,618

(22) PCT Filed: Sep. 10, 2010

(86) PCT No.: PCT/JP2010/066108

§ 371 (c)(1), (2), (4) Date: Mar. 1, 2012

(87) PCT Pub. No.: WO2011/034157

PCT Pub. Date: Mar. 24, 2011

(65) Prior Publication Data

US 2012/0154458 A1 Jun. 21, 2012

(30) Foreign Application Priority Data

Sep. 16, 2009 (GB) ..... 0916231.4

(51) Int. Cl.

*G09G 3/36* (2006.01)
*G09G 3/00* (2006.01)
*G09G 3/20* (2006.01)

(52) U.S. Cl.

CPC ..... *G09G 3/3648* (2013.01); *G09G 3/003* (2013.01); *G09G 3/2003* (2013.01); (Continued)

(58) Field of Classification Search

CPC ..... G09G 3/36; G09G 3/28; G09G 5/10; G09G 5/02; H04N 9/045; H04N 9/67; G02F 1/343

See application file for complete search history.

(56) References Cited

U.S. PATENT DOCUMENTS

RE27,617 E 4/1973 Olsen
4,764,410 A 8/1988 Grzywinski (Continued)

FOREIGN PATENT DOCUMENTS

GB 2 413 394 A 10/2005
GB 2 428 152 A 1/2007

(Continued)

OTHER PUBLICATIONS

International Search Report for corresponding International Application No. PCT/JP2010/066108 mailed Oct. 19, 2010.

(Continued)

*Primary Examiner* — Michael Faragalla

(74) *Attorney, Agent, or Firm* — Renner, Otto, Boisselle & Sklar, LLP

(57) ABSTRACT

A method of processing image data for display by a display panel of a display device is provided. The method comprises receiving main image pixel data representing a main and side image pixel data representing a side image. In a first processing step, a mapping is performed of the pixel data to signals used to drive the display panel. The mapping is arranged to produce an average on-axis luminance which is dependent mainly on the main image pixel data and an average off-axis luminance which is dependent at least to some extent on the side image pixel data. In a second processing step, the received side image pixel data are processed to emphasize at least one feature of the side image which might otherwise be perceived by a viewer as being de-emphasized in the side image displayed off axis as a result of the first processing step.

33 Claims, 6 Drawing Sheets

(52) U.S. Cl.
CPC ..... *G09G 3/2092* (2013.01); *G09G 2320/028* (2013.01); *G09G 2320/0606* (2013.01); *G09G 2320/068* (2013.01); *G09G 2360/16* (2013.01)

(56) References Cited

U.S. PATENT DOCUMENTS

| | | | | |
|---|---|---|---|---|
| 4,766,023 | A | 8/1988 | Lu | |
| 5,147,716 | A | 9/1992 | Bellus | |
| 5,528,319 | A | 6/1996 | Austin | |
| 2007/0040780 | A1 | 2/2007 | Gass et al. | |
| 2007/0075950 | A1 | 4/2007 | Yamada et al. | |
| 2007/0153196 | A1* | 7/2007 | Jang et al. | 349/141 |
| 2009/0079674 | A1 | 3/2009 | Yoshiga et al. | |
| 2009/0096734 | A1* | 4/2009 | Huang et al. | 345/89 |
| 2010/0149073 | A1* | 6/2010 | Chaum et al. | 345/8 |

FOREIGN PATENT DOCUMENTS

| | | | |
|---|---|---|---|
| GB | 2 457 106 | A | 8/2009 |
| GB | 2 464 521 | A | 4/2010 |
| JP | 2008-164743 | A | 7/2008 |
| JP | 2009-192615 | A | 8/2009 |
| WO | 2009/057417 | A1 | 5/2009 |
| WO | 2009/069048 | A1 | 6/2009 |
| WO | 2009/110128 | A1 | 9/2009 |

OTHER PUBLICATIONS

International Preliminary Report on Patentability for corresponding International Application No. PCT/JP2010/066108 issued Apr. 11, 2011.

British Search Report for corresponding GB Application No. GB0916231.4 dated Dec. 17. 2009.

Yamada et al., "Fast Response and Wide-Viewing Angle Technologies for LC-TV Application", ASV, IDW '02 Digest, pp. 203-206.

Hanaoka et al., "A New MVA-LCD by Polymer Sustained Alignment Technology", PSA SID '04 Digest, pp. 1200-1203.

* cited by examiner

APPARATUS, DISPLAY DEVICE, AND METHOD THEREOF FOR PROCESSING IMAGE DATA FOR DISPLAY BY A DISPLAY PANEL

TECHNICAL FIELD

The present invention relates to an apparatus, a display device, a program and method thereof for processing image data for display by a display panel in a display device, such as an active matrix display device, which is operable in a private display mode.

BACKGROUND ART

In a first, public, mode of a display device that is switchable between a public and private display mode, the device commonly behaves as a standard display. A single image is displayed by the device to as wide a viewing angle range as possible, with optimum brightness, image contrast and resolution for all viewers. In the second, private mode, the main image is discernible only from within a reduced range of viewing angles, usually centred on the normal to the display surface. Viewers regarding the display from outside this reduced angular range will perceive either a second, masking image which obscures the main image, or a main image so degraded as to render it unintelligible.

This concept is illustrated in FIG. 4 of the accompanying drawings, in which a "main view" 402 of a display device 401 is visible substantially only to the principal user 404 of the display device 401 when his or her eye is close to the principal axis of the display device 401, and one or more "side views" 403 designed to be visible to other users 405 assumed to be off-axis.

This concept can be applied to many devices where a user may benefit from the option of a privacy function on their normally wide-view display, for use in certain public situations where privacy is desirable. Examples of such devices include mobile phones, Personal Digital Assistants (PDAs), laptop computers, desktop monitors, Automatic Teller Machines (ATMs) and Electronic Point of Sale (EPOS) equipment. Such devices can also be beneficial in situations where it is distracting and therefore unsafe for certain viewers (for example drivers or those operating heavy machinery) to be able to see certain images at certain times, for example an in car television screen while the car is in motion.

Several methods exist for adding a light controlling apparatus to a naturally wide-viewing range display:

One such structure for controlling the direction of light is a 'louvred' film. The film consists of alternating transparent and opaque layers in an arrangement similar to a Venetian blind. Like a Venetian blind, it allows light to pass through it when the light is travelling in a direction nearly parallel to the layers, but absorbs light travelling at large angles to the plane of the layers. These layers may be perpendicular to the surface of the film or at some other angle. Methods for the production of such films are described in a USRE27617 (F. O. Olsen; 3M 1973), U.S. Pat. No. 4,766,023 (S.-L. Lu, 3M 1988), and U.S. Pat. No. 4,764,410 (R. F. Grzywinski; 3M 1988).

Other methods exist for making films with similar properties to the louvred film. These are described, for example, in US05147716 (P. A. Bellus; 3M 1992), and US05528319 (R. R. Austin; Photran Corp. 1996).

Louvre films may be placed either in front of a display panel or between a transmissive display and its backlight to restrict the range of angles from which the display can be viewed. In other words, they make a display "private".

The principal limitation of such films is that they require mechanical manipulation, i.e. removal of the film, to change the display between the public and private viewing modes:

In GB2413394 (Sharp, 2004), an electronically switchable privacy device is constructed by adding one or more extra liquid crystal layers and polarisers to a display panel. The intrinsic viewing angle dependence of these extra elements can be changed by switching the liquid crystal electrically in the well-known way. Devices utilising this technology include the Sharp Sh851i and Sh902i mobile phones.

The above methods suffer the disadvantage that they require the addition of extra apparatus to the display to provide the functionality of electrically switching the viewing angle range. This adds cost, and particularly bulk to the display, which is very undesirable, particularly in mobile display applications such as mobile phones and laptop computers.

Methods to control the viewing angle properties of an LCD by switching the single liquid crystal layer of the display between two different configurations, both of which are capable of displaying a high quality image to the on-axis viewer are described in US20070040780A1 (Sharp, 2005) and WO2009057417A1 (Sharp, 2007). These devices provide the switchable privacy function without the need for added display thickness, but require complex pixel electrode designs and other manufacturing modifications to a standard display.

An example of a display device with privacy mode capability with no added display hardware complexity is disclosed in WO 2009/069048. Another such example is provided in US20090079674A1, which discloses a privacy mode for a display in which different levels of signal voltage are applied to adjacent pixels so that an averaged brightness of those pixels varies with the signal voltages according to the display's gamma curve to show an expected image when viewed on axis, and in which the averaged brightness is at a constant level within a specified voltage range when viewed off axis, so as to change a contrast of the image to a visibly unidentifiable degree off axis.

Another example of a display device with privacy mode capability with no added display hardware complexity is the Sharp Sh702iS mobile phone. This uses a manipulation of the image data displayed on the phone's LCD, in conjunction with the angular data-luminance properties inherent to the liquid crystal mode used in the display, to produce a private mode in which the displayed information is unintelligible to viewers observing the display from an off-centre position. However, the quality of the image displayed to the legitimate, on-axis viewer in the private mode is severely degraded.

Similar schemes to that used on the Sh702iS phone, but which manipulate the image data in a manner dependent on a second, masking, image, and therefore causes that masking image to be perceived by the off-axis viewer when the modified image is displayed, are given in GB2428152A1 (published on 17 January 2007) and GB application GB0804022.2 (published as GB2457106A on 5 Aug. 2009). The method disclosed in the above publications uses the change in data value to luminance curve with viewing angle inherent in many liquid crystal display modes such as "Advanced Super View" (ASV) (IDW'02 Digest, pp 203-206) or Polymer Stabilised Alignment (PSA) (SID'04 Digest, pp 1200-1203).

The data values of the image displayed on the LC panel are altered in such a way that the modifications applied to neighbouring pixels effectively cancel out when viewed from the front of the display (on-axis), such that the main image is reproduced, but when viewed from an oblique (off-axis) angle, the modifications to neighbouring pixels result in a net luminance change, dependent on the degree of modification applied, so the perceived image may be altered.

It is desirable to provide improvements to the method described in GB2428152A1 and GB2457106A.

SUMMARY OF INVENTION

According to a first aspect of the present invention, there is provided a method of processing image data for display, by a display panel of a display device, comprising: receiving main image pixel data representing a main image and side image pixel data representing a side image; in a first processing step, performing a mapping of the pixel data to signals used to drive the display panel, wherein the mapping is arranged to produce an average on-axis luminance which is dependent mainly on the main image pixel data and an average off-axis luminance which is dependent at least to some extent on the side image pixel data; and, in a second processing step, processing the received side image pixel data in order to emphasise at least one feature of the side image which might otherwise be perceived by a viewer as being de-emphasised in the side image displayed off axis as a result of the first processing step.

According to a second aspect of the present invention there is provided an apparatus arranged to perform a method of processing image data for display by a display panel of a display device, the method comprising: receiving main image pixel data representing a main image and side image pixel data representing a side image; in a first processing step, performing a mapping of the pixel data to signals used to drive the display panel, wherein the mapping is arranged to produce an average on-axis luminance which is dependent mainly on the main image pixel data and an average off-axis luminance which is dependent at least to some extent on the side image pixel data; and, in a second processing step, processing the received side image pixel data in order to emphasise at least one feature of the side image which might otherwise be perceived by a viewer as being de-emphasised in the side image displayed off axis as a result of the first processing step.

According to a third aspect of the present invention there is provided a display device comprising an apparatus according to the second aspect of the present invention.

According to a fourth aspect of the present invention there is provided a program for controlling an apparatus to perform a method according to the first aspect of the present invention or which, when loaded into an apparatus, causes the apparatus to become an apparatus or device according to the second or third aspect of the present invention. The program may be carried on a carrier medium. The carrier medium may be a storage medium. The carrier medium may be a transmission medium.

The foregoing and other objectives, features, and advantages of the invention will be more readily understood upon consideration of the following detailed description of the invention, taken in conjunction with the accompanying drawings.

DESCRIPTION OF EMBODIMENTS

Figure 1:
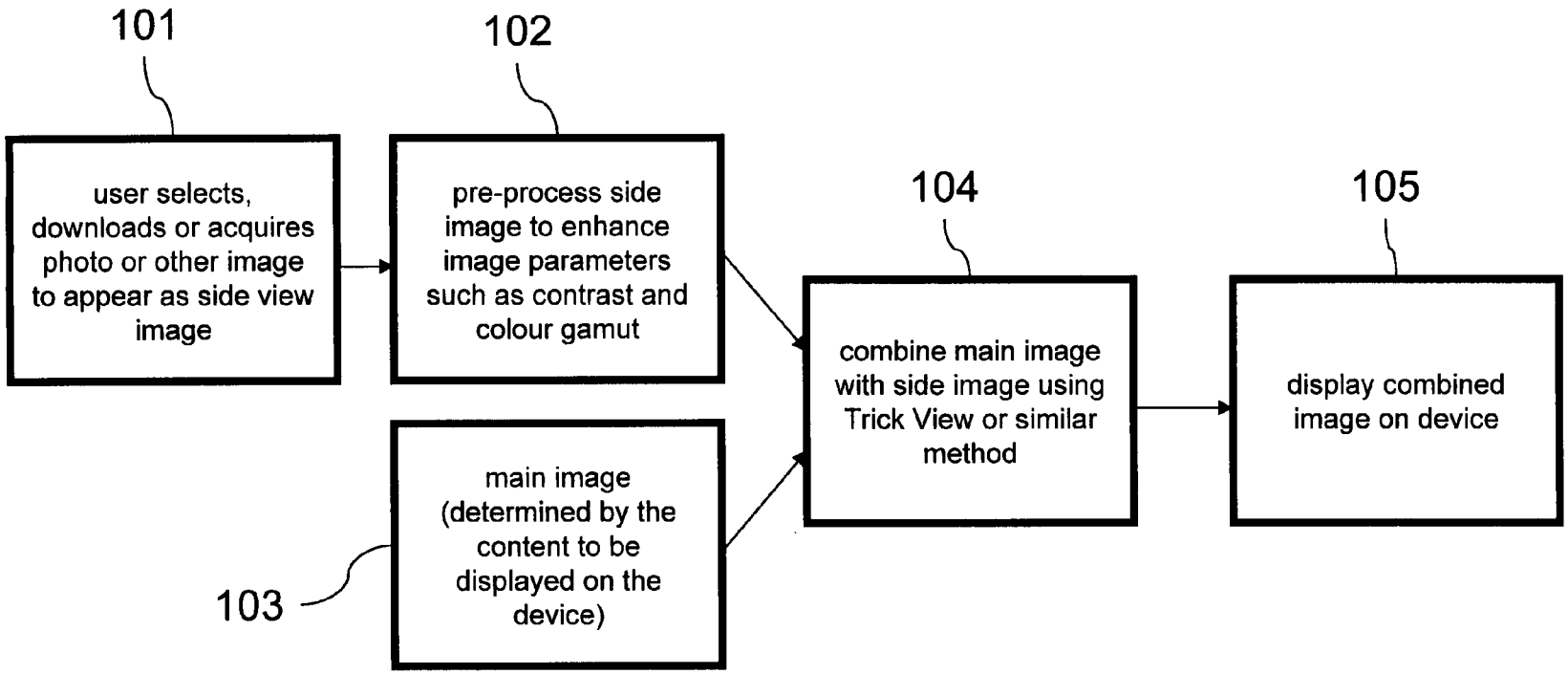
FIG. 1 illustrates schematically a method according to an embodiment of the present invention.

In previously-considered approaches to providing a privacy effect, it is usual that the side image is displayed at low resolution, low bit-depth and low contrast, compared to the capabilities of the display operating in normal viewing mode. Typical values include ¼ spatial resolution (i.e. ¼ of the number of addressable pixels of the physical display), 64 colours (2 bits per colour per pixel) and only 2:1 contrast. These numbers represent a trade off between (i) image quality of the main view (ii) strength of security (that is, how little main image leaks to the sides) and (iii) image quality of the side view.

Simply applying a normal image (such as taken with a digital camera) to appear in a side view generally results in poor perceived quality for the side viewer. Because of this, the user is typically presented with either no choice for the side image; or else a limited choice of side images that have been specially selected (perhaps by the manufacturer or supplier of the device) to appear acceptable with such a limited display capability. A similar restricted choice applies in the case that the side image changes over time to create a "side movie."

The present applicant has appreciated that it would be desirable to address the above-identified problems, and accordingly has devised a scheme which allows a user to select his or her own photos to appear as side images, in order to personalise a device such as a mobile phone, whilst retaining reasonable perceived quality. This would extend the usefulness of the private mode, beyond acting for example merely as a privacy mechanism and providing benefits in areas such as advertising (e.g. branding) and personalisation.

Algorithms for enhancing contrast, colour saturation, noise removal, selective smoothing and sharpening are well known for improving the perceived quality of an image. For displays of limited bit depth, dithering is a well known process to increase the apparent bit depth at the cost of spatial resolution. Contrast enhancement methods are available for moderately low contrast displays, including global and locally adaptive luminance stretches. Moving images may be improved by individually filtering each frame or by using 3D filters that take a sequence of images into account.

However, the idea underlying an embodiment of the present invention is to apply image processing with extreme parameters, normally too strong for viewing on ordinary devices, to enhance images so that they may be used successfully as side images.

In an embodiment of the present invention it is recognised that some fine details and visual subtleties of the image are inessential to this application, so can be safely ignored; and that more of the contrast, spatial resolution or colour space resources available are used to enhance the broad, coarse features of the image. The present applicant has observed that the side image viewer is typically further from the display than the main image viewer, and so only the broad, coarse features of a side image would generally be visible. For example, the side viewer would not be expected to read text, other than perhaps large logos or slogans.

An embodiment of the present invention provides an advantage that it provides a technical solution which allows users to personalise their portable devices with more freedom, and still have recognisable images shown to the sides of a directional display An embodiment of the present invention can be used in conjunction with the display device as set out in GB2457106A. The display device of GB2457106A will not be described in detail herein, and instead the entire content of GB2457106A is considered to be incorporated herein. GB0819179.3(published as GB2464521A on 21 Apr. 2010) discloses an "image processing filter" step in the context of a privacy display such as that described in GB2457106A, but in that disclosure particular patterns of pixel data which may result in specific colour artefact problems are detected and altered before the main image data is input to the privacy module.

Figure 5:
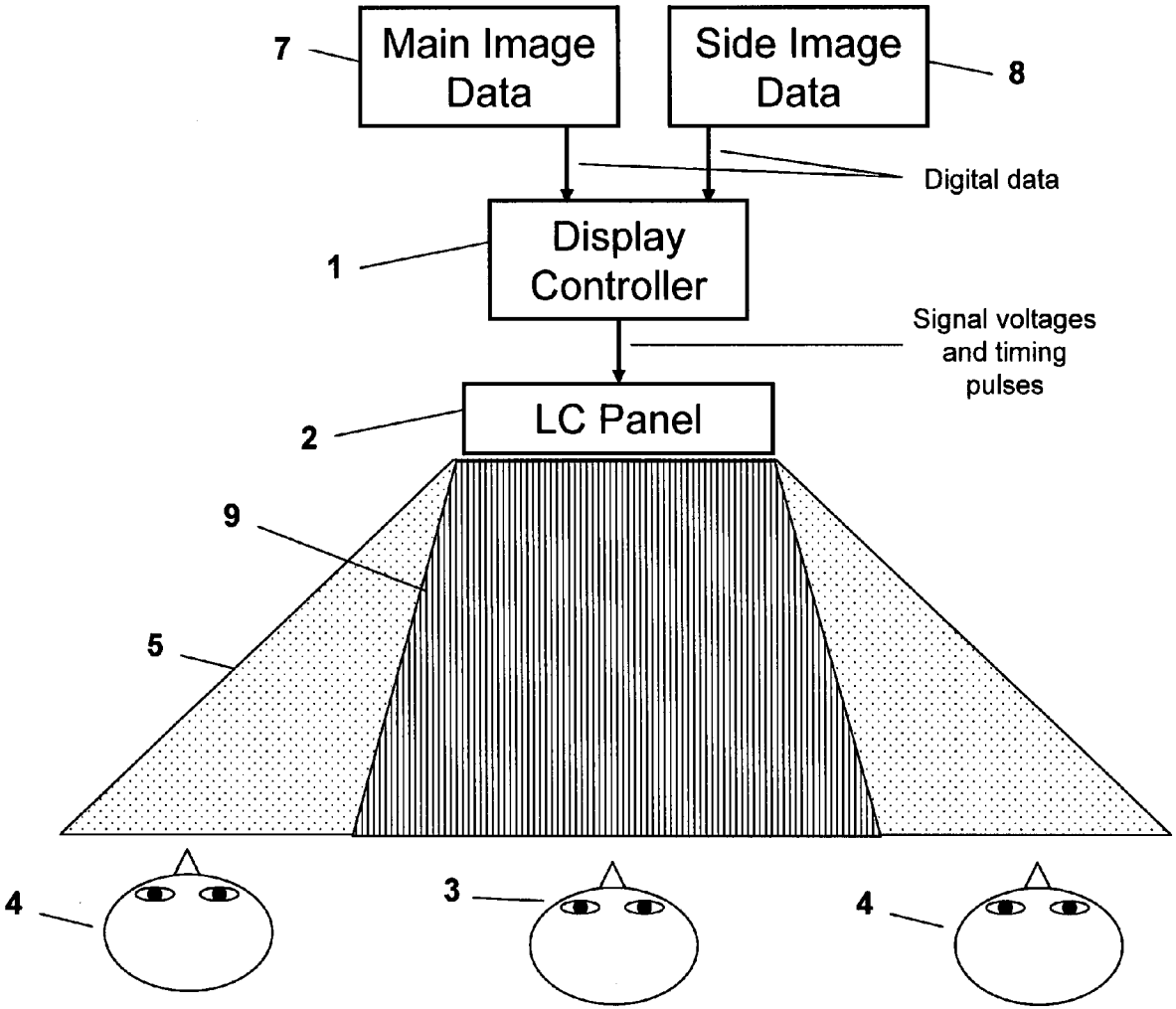
FIG. 5 is a schematic of a display described in GB2457106A, and to which an embodiment of the present invention can be applied, when operating in the private mode.

FIG. 5 illustrates a display device as described in GB2457106A. A display device is provided that comprises a liquid crystal display panel 2 for displaying an image by spatial light modulation. When the device is operating in the private mode, two image datasets are input to a display controller 1 in every frame period: main image data 7 constituting a main image, and side image data 8 constituting a side image. The display controller 1 then outputs a set of signal data voltages, one data voltage for each pixel in the LC panel. The display controller 1 utilises an expanded look-up table (LUT) and the output signal data voltage for each pixel in the LC panel, constituting a combined image, is dependent on the data values for the corresponding pixel (in terms of spatial position in the image) in both the main 7 and side 8 images. The output data voltage for each pixel may also be dependent on a third, spatially dependent, parameter determined by the spatial position of the pixel within the display. The signal voltages from the display controller 1 cause the LC panel 2 to display a combined image to a wide cone 5 of angles. The image observed by the main viewer 3 is recognisably the main image, with minimal degradation of the main image quality. However, due to the different gamma curve characteristic of the LC panel for the off-axis viewers 4, these off-axis observers perceive the side image most prominently, which obscures and/or degrades the main image, securing the main image information to viewers within a restricted cone 9 of angles centred on the display normal.

In GB2457106A, the relationship between the input and output image data values is determined as follows:

In a first step, both the main and secondary images have their pixel data values converted to equivalent luminance values, $M_{Lum}(x,y,c)=M_{in}(x,y,c)^{\gamma}$, $S_{Lum}(x,y,c)=S_{in}(x,y,c)^{\gamma}$, where $M_{in}$ and $S_{in}$ are normalised to have values between zero and one, and $\gamma$ is the exponent relating the data value to luminance of the display, known as the display gamma and typically having a value of 2.2.

In a second step, these luminance values of the main image are then compressed by a factor $\beta$ and raised by an offset factor $\partial$: $M_{cmp}(x,y,c)=\beta\cdot M_{Lum}(x,y,c)+\partial$. Each pixel luminance value in the side image is then scaled by a factor equal to the difference between the luminance value of the corresponding pixel in the compressed main image and the edge of the range (0 or 1, whichever is closer). This difference can be obtained for any luminance value from the r.m.s. of the difference between the value and the centre of the range. Therefore the side image luminance values are scaled as $S_{cmp}(x,y,c)=S_{Lum}(x,y,c)\cdot(0.5-\sqrt{(M_{cmp}(x,y,c)-0.5)^2})$. A minimum value greater than zero may be specified for the transformed equivalent luminance value for the side data value.

In the above, $\sqrt{(M_{cmp}(x,y,c)-0.5)^2}$ is equivalent to $|M_{cmp}(x,y,c)-0.5|$, which is the absolute amount by which $M_{cmp}(x,y,c)$ differs from 0.5.

In a third step, the compressed main and side images are combined, now with the addition/subtraction of luminance patterned on a sub-pixel level, for example using the spatially-varying parameter referred to previously. Colour sub-pixels are grouped into pairs with one pixel in each having its output luminance equal to the sum of the compressed main and side image luminances at that pixel, and the other having an output luminance equal to the compressed main image luminance minus the compressed side image luminance. Therefore, for the maximum value of $S_{Lum}$, one of the pair is always modified so as to take it either to the maximum or to the minimum of the normalized range (whichever is closer), with the other of the pair being modified in the opposite direction. The amount of such splitting, for a particular value of $M_{in}$, is determined by the value of $S_{Lum}$.

PCT/JP2008/068324 (published as WO 2009/110128 on 11 Sep. 2009), which is based on GB2457106A, also discloses a method to obtain an accurate colour side image effect, in which the side image of 2 bit per colour (6 bit total) depth is input to the control electronics, and four pairs of output values are included in the expanded LUT for every main image data value, the output value pairs being calculated according to the following method:

$$C(x,y,c)=M_{cmp}(x,y,c)\pm 1\times S_{cmp\ max}(x,y,c),\text{for } S_{in}=0$$

$$C(x,y,c)=M_{cmp}(x,y,c)\pm 0.98\times S_{cmp\ max}(x,y,c),\text{for } S_{in}=1$$

$$C(x,y,c)=M_{cmp}(x,y,c)\pm 0.85\times S_{cmp\ max}(x,y,c),\text{for } S_{in}n=2$$

$$C(x,y,c)=M_{cmp}(x,y,c)\pm 0,\text{for } S_{in}=3$$

where "$S_{cmp\ max}$" is the maximum available compressed side image value, calculated as previously, i.e. for $S_{cmp\ max}=|M_{cmp}(x,y,c)|$.

Figure 6:
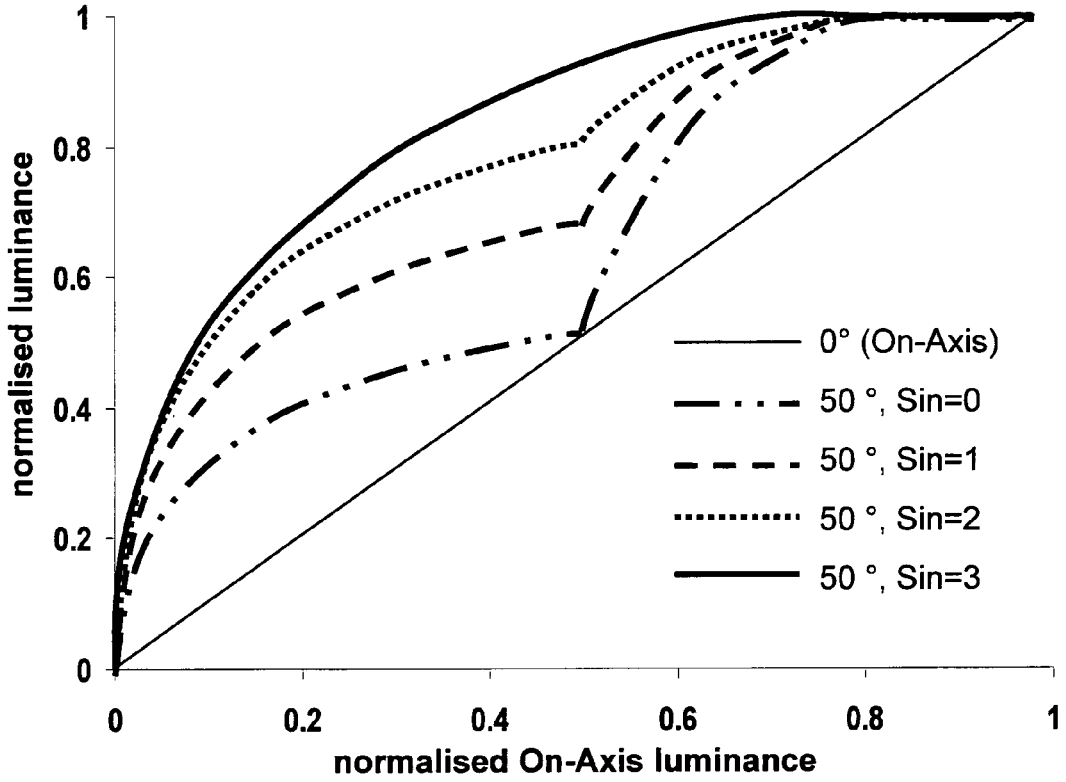
FIG. 6 is graph showing the multiple normalised off-axis to on-axis luminance curves provides by a display of the type described in GB2457106A.

The above previously-considered method of calculation has four possible side image values: $S_{in}=0$, 1, 2 and 3. As can be seen in FIG. 6, when $S_{in}=0$, maximum splitting is used for each main image data value, resulting in the lowest overall luminance off-axis across the range of on-axis luminances. When $S_{in}=3$, no splitting is used, resulting in the highest overall luminance off-axis across the range of on-axis luminances. The suggested values of 0.98 and 0.85 times the maximum available change to the $M_{cmp}$ data for the mid-range side image values $S_{in}=1$ and 2 respectively has been found to produce approximately even increments in the off-axis luminance for the different input side image values. This means the different side image states retain a good degree of proportionality relative to each other over the whole on-axis luminance range.

The above-described mapping is arranged to produce an average on-axis luminance which is dependent mainly on the main image pixel data and an average off-axis luminance which is dependent at least to some extent on the side image pixel data. However, it tends to result in at least one feature of the side image being perceived by a viewer as being de-emphasised in the side image displayed off axis. An embodiment of the present invention aims to address this by arranging for the side image pixel data to be processed in order to emphasise the at least one feature of the side image which might otherwise be perceived by a viewer as being de-emphasised in the side image displayed off axis.

For example, the at least one feature may be emphasised in an embodiment of the present invention to an extent at least as great as the extent to which the at least one feature is perceived as being de-emphasised in the side image displayed off axis. The at least one feature may be emphasised in an embodiment of the present invention at least to compensate for the perceived de-emphasis in the side image displayed off axis. The at least one feature may be emphasised in an embodiment of the present invention to an extent that is greater than would normally be considered appropriate for an image without the perceived de-emphasis in the side image displayed off axis.

FIG. 1 is a schematic view of how the present method can be applied to a device having a privacy mode such as that summarised above and described in further detail in GB2457106A. The user interface of the device operates to allow the user the opportunity to customise the privacy function by selecting a side image (step 101). The side image may be a photograph or image acquired by a camera within the device, or a previously stored photograph or image, or may be downloaded from a remote image server if the device is connected to a suitable network. The result is an image that the user would like to appear as the side image when the display is in privacy mode. This image is pre-processed (step 102) using various image processing methods to enhance parameters such as contrast, use of colour space, resolution etc, and this will be discussed in further detail below. When the device is being used in privacy mode a main image, received in step 103, is combined with the processed side image (step 104) using the appropriate privacy mechanism for the device (an example of which from GB2457106A is summarised above). The resultant image is displayed on the device (step 105).

The pre-processing step (step 102) may be performed once in advance (off-line) and its result stored for later use in the combination step (step 104). Alternatively, the pre-processing step (step 102) may be performed repeatedly in real time as and when required (on-line), so that the result is immediately used in the combination step (step 104), and only the original side image needs to be kept in long-term storage. Similarly, part of the pre-processing may be off-line, and part on-line; for example if the pre-processing consists of a number of different processing steps then some of those steps can be performed off-line and others can be performed on-line. The decision on which architecture is most appropriate to a specific implementation of course will depend on the available resources and the requirements of the other steps.

Figure 2:
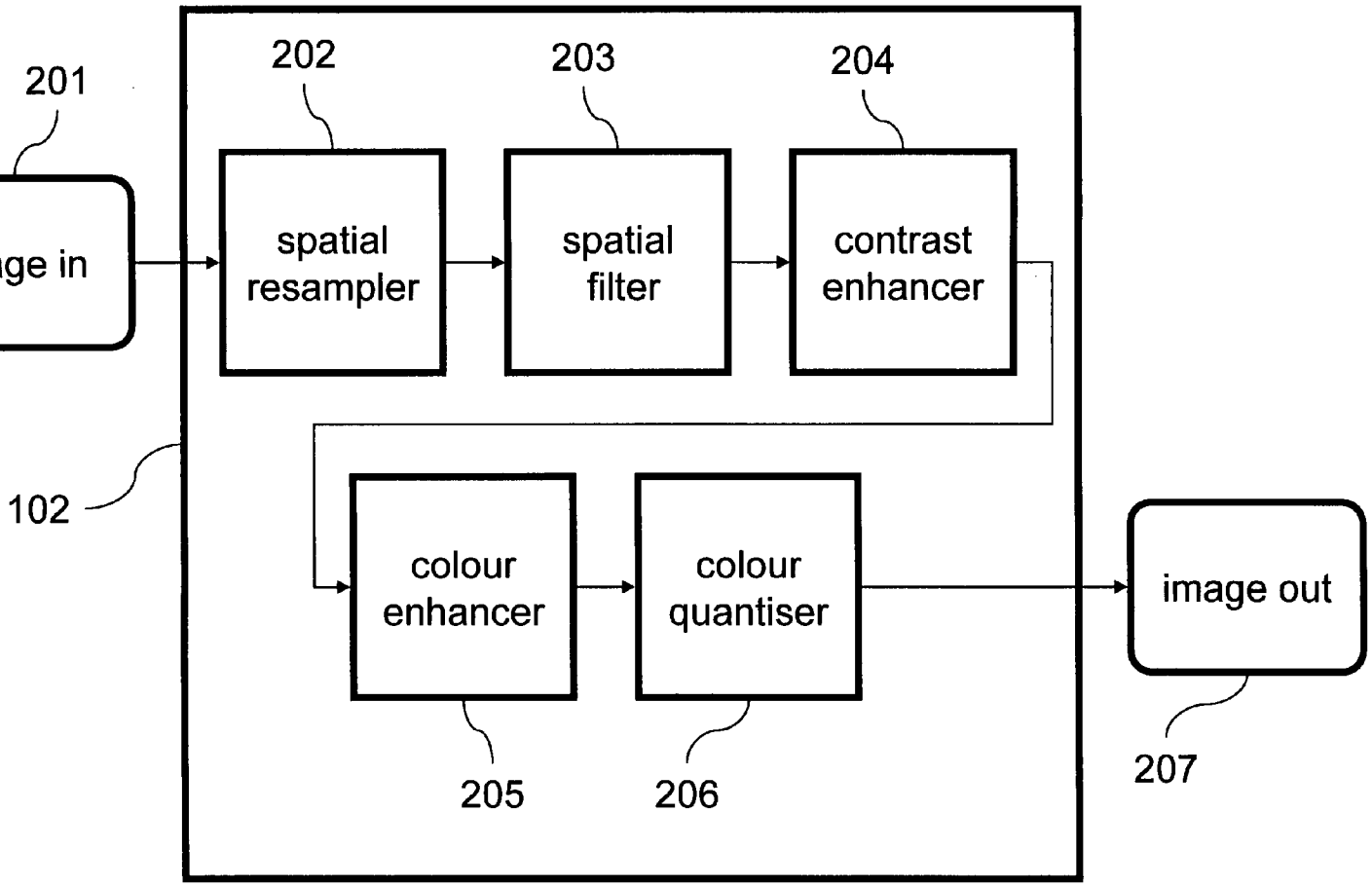
FIG. 2 shows an example pre-processing chain for use in an embodiment of the present invention.

FIG. 2 shows one scheme for implementing the pre-processing step 102 shown in FIG. 1. The input image 201 is spatially resampled by a spatial resampler 202 so that it has the correct number of pixels for the target device. Next a spatial filter 203 is used to enhance spatial features such as edges and photographic subject whilst reducing background detail. Next a contrast enhancer 204 is used to enhance contrast and to make full use of the available luminance range of the display. Next, a colour enhancer 205 performs a similar function in respect of colour range rather than contrast. Next a colour quantiser 206 is used to reduce the number of colours requested for display, and the resulting image is output 207. Each of these components is described in further detail below.

Other embodiments are possible in which the steps occur in a different order, or one or more of the steps are omitted. As in many image processing applications, there is a trade-off between the amount of processing time or circuitry required and the quality achieved.

For example, the spatial down-sampling may occur later in the chain. This means that steps before the down-sampling have to work at full resolution, and thus require more processing. However, it may be beneficial to the final image to perform the spatial filtering on the full resolution image.

Also, the same effect may be obtained by combining two or more steps into a single step, splitting single steps into two or more steps, or by otherwise redistributing the computations amongst the steps. Such reorganisation will be well understood by those who develop and implement image processing algorithms.

For example, the contrast enhancement and colour enhancement steps may be combined into a single step in order to share common parts of the calculation. In particular, both may make use of a pixel value expressed in HSV colour space. Then it is natural to convert to HSV once, act on the S and the V coordinates to achieve both contrast enhancement and colour enhancement, and only then convert into a colour space more natural for the remaining operations.

For example, the spatial resampler 202 may require a sharpening operation as one of its sub-steps, which could conveniently, perhaps, be incorporated in the spatial filter 203.

Spatial resampling by the spatial resampler 202 reduces (or increases) the number of pixels in the image, so that the image is the correct size for use as a side image. For example, side images typically have only one quarter of the number of pixels as compared to the size of the full display. Within the spatial resampling any cropping or stretching may be applied to achieve not only the correct number of pixels but also the correct aspect ratio. Resampling may be achieved simply by repeating or dropping pixels. A better image may be obtained using filters such as the Lanczos filter, bilinear or bicubic interpolation or other methods in a similar spirit. Resampling is often preceded by low pass filtering (with a small gaussian kernel, for example), and followed by sharpening (with an unsharp mask, for example), as is well known.

The purpose of the spatial filter 203 is to emphasise image features which would create a better side image, and de-emphasise spatial image features which would detract from a better side image. It may also remove artefacts generated by digital compression.

For example, it may be advantageous to enhance major edges defining the principal subject of the image. This behaviour may be approximated by a simple sharpening filter, such as the unsharp mask method. A more complex algorithm that detects the photographic subject could be used to direct this step.

It may be advantageous to remove high-spatial-frequency information from the image background, using a low-pass filter.

The spatial filter may comprise a bilinear filter, or other spatial filter which also uses data values of points within the filter area to adjust the weightings in the filter. The filter may be adaptive to local features in the image, such as direction of edges.

In the case of processing a frame of a movie, the spatial filter may incorporate data from other frames in the movie.

The purpose of contrast enhancement by the contrast enhancer 204 is to make full use of the low contrast available in a side view. It is desirable to make use of a wide range of luminance values, but without destroying too much detail by over-saturation. To do this it is preferable to operate in a colour space with an explicit coordinate that determines (or approximately determines) the luminance. However, an approximation may be achieved by simply operating on the R, G and B components individually.

Figure 3:
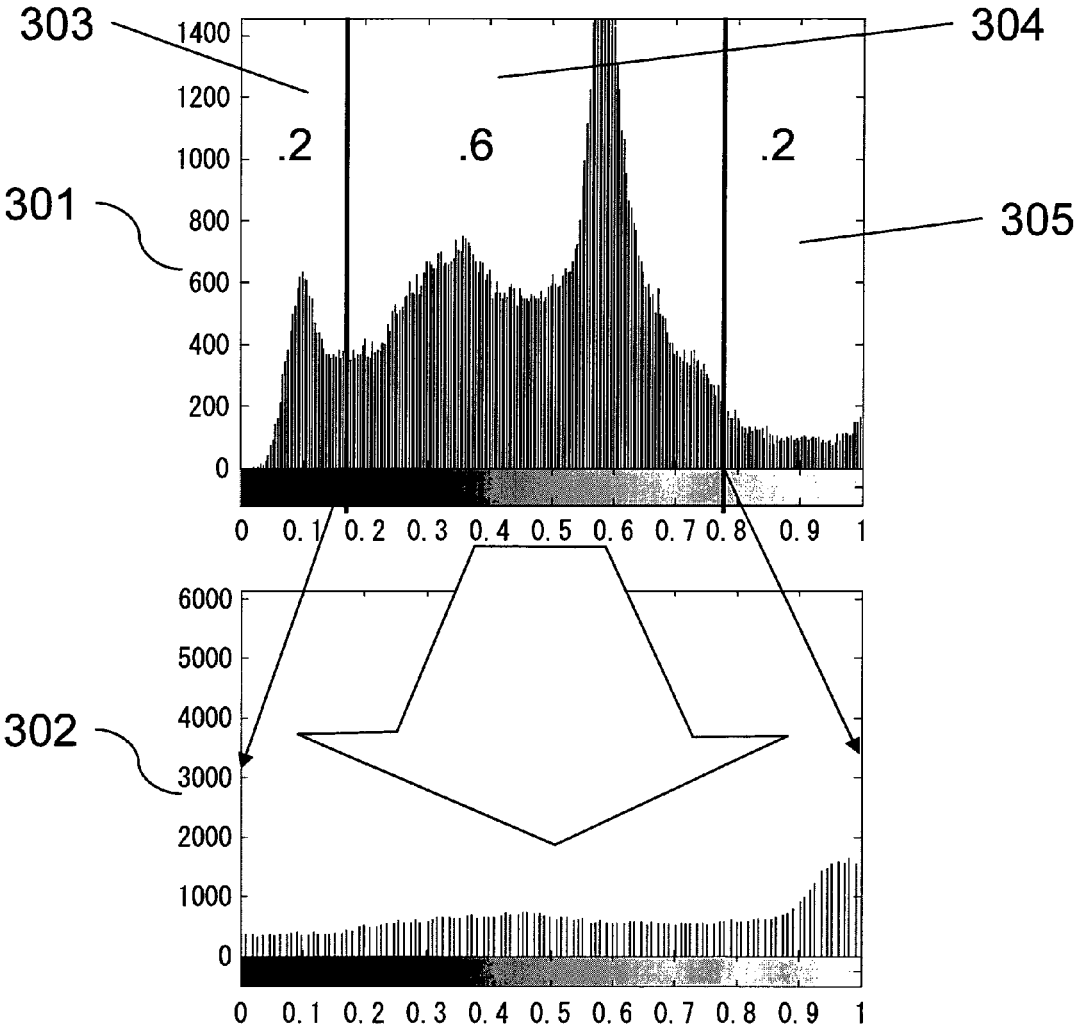
FIG. 3 shows an example of histogram-based enhancement.
Figure 4:
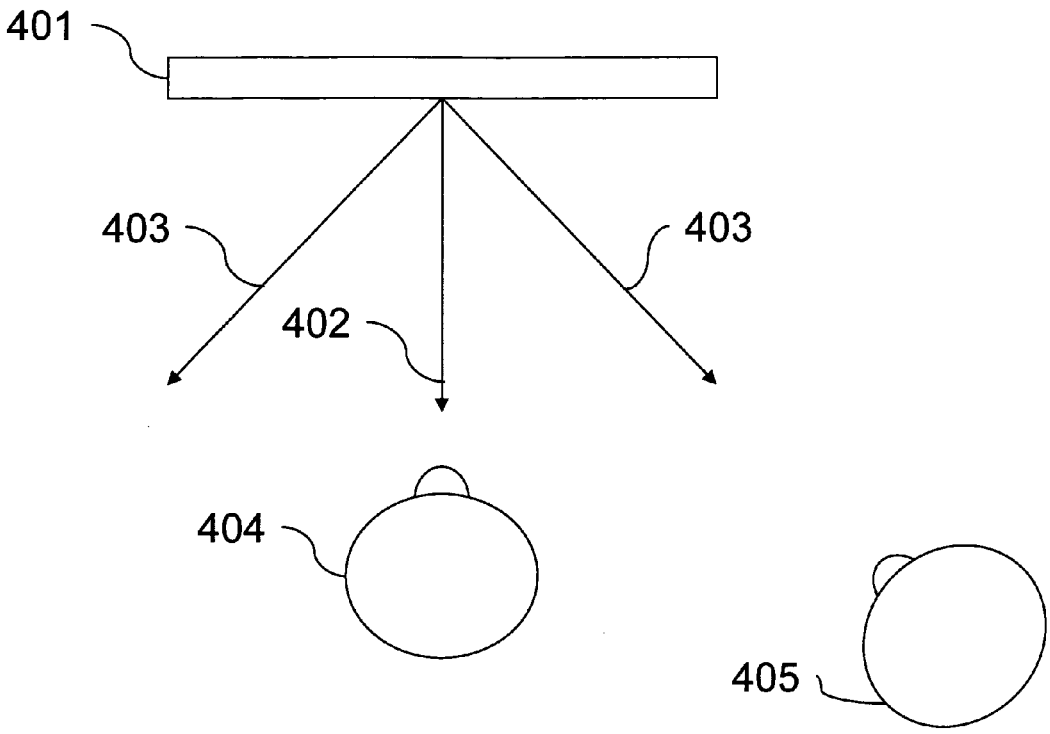
FIG. 4 shows an example of a privacy display and user of the display, as seen from above.

There are many ways to enhance contrast, as is well known. One particular method is illustrated in part in FIG. 3. Each pixel in the original and final image is associated with a luminance level. For example, the pixel may be represented in a colour space in which luminance (or similar quantity) is explicit, such as for example L* in CIEL*a*b*, V in HSV, L in HLS, Y in YUV, Y in YCbCr etc. The distribution is then calculated of the luminances of all the original pixels, which has been visualised here as a histogram (301). In (301) luminance values have been scaled from 0 (black) to 1 (white) and are shown on the horizontal axis. Parameters are selected to determine how the luminances should be modified. For example, FIG. 3 illustrates a histogram in which the darkest 20% pixels (303) are mapped to black, 20% lightest pixels (305) to white and the remaining 60% (304) spread evenly in between. The resulting luminance distribution is illustrated here as a second histogram (302). Finally the modified luminances are mapped back to their respective pixels, resulting in a contrast enhanced image. This can be considered to be tonal contrast enhancement.

Other methods may be used; in particular methods which enhance the contrast locally in regions of the image may be preferred. Contrast enhancement is also possible using an unsharp mask filter having a relatively large value for the "radius" parameter; this can be considered to be spatial contrast enhancement, where the overall contrast of an image is enhanced by boosting local contrast according to an algorithm that takes account of the image data within a region of the image.

Simple linear scaling of the luminance (with values out of range mapped to black or white), or gamma correction methods may be used, although the results are likely to be worse.

It may be advantageous to emphasise contrast only for pixels comprising the photographic subject, and optionally de-emphasise contrast for the background.

It may be advantageous to emphasise contrast of a pixel in dependence on the colour of that pixel.

The purpose of colour enhancement by the colour enhancer 205 is to make colours unnaturally vivid, since they will lose much of this vividness when the image is combined in step 104. It is desirable to make use of a wide range of colour values, but without destroying the basic colours. For example, reds should continue to look red, even if they are more saturated than before. To do this it is preferable to operate in a colour space with an explicit coordinate that determines (or approximately determines) the amount of colour saturation.

A preferred colour enhancement can be explained in the same way as contrast enhancement. In this case it is the colour saturation value of each pixel that is modified, rather than the luminance. FIG. 3 may thus be reinterpreted to illustrate a stretch of the saturation value of each pixel, though the choice of parameters may differ. For a colour enhancement one would operate, depending on the choice of colour space, on C* in CIE L*a*b*, S in HSV, S in HLS etc. In this interpretation the horizontal axis of histogram (301) varies from 0 (monochrome) to 1 (fully saturated colour).

Thus the preferred procedure for colour enhancement would be to convert each pixel representation to a colour space (say HSV) if necessary; calculate the distribution of the S components; determine the split points; map pixels with S below the lower split point to S=0; map pixels with S above the upper split point to S=1; map the S components of the remaining pixels linearly so that the lower split point maps to 0 and the upper split point maps to 1; optionally convert each pixel back to the colour space needed for the next step. As with luminance enhancement, the saturations falling within a predetermined saturation range could be stretched to fill the entire range of saturations; for example, the lower 20% of saturation values could be mapped to a zero saturation value, while the upper 20% of saturation values could be mapped to a maximum saturation value, with the remaining 60% spread evenly in between.

As with luminance enhancement other implementations could be used, for example linear scaling of the V component in HSV representation of pixels, or a locally adaptive method.

It may also be advantageous to operate more cautiously on skin tones, such that pixel data within a range of human skin tones are processed differently to pixel data outside the range of human skin tones, to avoid over saturation in parts of the spectrum where the eye is particularly critical.

It may be advantageous to emphasise saturation of colours only for pixels comprising the photographic subject, and optionally de-emphasise saturation of colours for the background.

It may be advantageous to emphasise colour saturation of a pixel in dependence on the colour of that pixel.

The purpose of colour quantisation by the colour quantiser 206 is to reduce the full range of colours in the image to those available to the combiner step 104. For example, in one kind of privacy display only two bits are used in the combination procedure to represent each component, R, G or B of a side image pixel. Thus one would have to limit the colours used to only $2^2 \times 2^2 \times 2^2 = 4 \times 4 \times 4 = 64$ distinct colours, and those colours are determined in advance.

The simplest method of quantisation is simply to choose for each pixel the nearest available colour. If there are enough available colours (for example, 6 or more bits per colour component), this method will work well enough.

However, with only 64 colours this simple method will tend to result in visible contours where colour or luminance changes suddenly, even where the input image is smooth.

A preferred method of quantisation is to choose for each pixel the nearest available colour, but then to record the resulting colour error in making this choice, and to try to cancel out the colour error when choosing nearby pixel values (since the eye tends to see only average values over a region). This is the well known method of dithering by error diffusion.

It will also be appreciated by the person of skill in the art that various modifications may be made to the above-described embodiments without departing from the scope of the present invention as defined by the appended claims.

For example, it may be advantageous to take account of the main image, if at least part of the pre-processing occurs when the main image is already known. For example, in some privacy display technologies, particular patterns in the main image (such as areas of low brightness) may result in especially poor side view contrast. In such a case it may be advantageous to boost the side image contrast in such areas to compensate.

When processing the side image it may be advantageous to identify the type of side image, or identify the type of different regions of the side image. The type information could be used to control the order, the kind or the parameters of the processing steps for the side image. For example, a text portion of the side image might benefit from using only simple quantisation rather than error diffusion dithering, or from the use of more extreme contrast enhancement compared to non-text portions (i.e. portions of the side image having little or no text). Similar modifications might apply for line drawings or cartoon content. In the case of photos, portraits might be handled differently from general scenery or action shots. Text could be read using OCR technology, and rendered in a specially selected font and colour for maximum clarity.

The type of a side image photo can be decided automatically, or by a hint from the user using a limited number of choices to be offered via the user interface of the device. The type of photo may also be encoded in meta-data in the photo and used by the privacy device to direct the pre-processing.

The pre-processing may occur entirely automatically, or with interaction from the user. Thus the user may optionally indicate the type of the image, and optionally adjust the pre-processing parameters. Optionally the effect of each adjustment may be shown to the user to assist in further adjustments.

It may be advantageous to provide the facility to optionally crop and optionally resize the image before pre-processing. This could occur under user direction, or could occur automatically in some situations, such as if a portrait is detected.

Privacy displays typically make some trade-off between main view and side view quality. If the trade-off is such that the quality of the main view is poor it may be advantageous to enhance at least part of the main image using the kind of pre-processing described previously as being applicable to the side image. In particular, if the contrast of the main view is low, then contrast enhancement could be applied to the main image.

In another embodiment a movie (video) can be used as a side view by treating it as a series of still images to be displayed in sequence. Each frame (or field) of the movie may be pre-processed (step 102) before combining with a main image at the appropriate moment to achieve the effect of motion in the side view. The pre-processed frames may be stored for later use (off-line), or may be generated just in time for display (on-line) and then discarded.

Intermediate solutions are envisaged, in which part of the pre-processing occurs off-line, resulting in storage of a partially processed movie, and the remainder on-line, just in time for display. In particular it may be advantageous to analyse the content of the movie to determine pre-processing parameters off-line, and then perform the pre-processing on-line.

In an extension of this embodiment data is extracted from one or more frames (such as colour histogram information) and used to control the pre-processing of other frames. This allows a more efficient implementation (for example, reducing the requirement of buffering data) in case the pre-processing is occurring just before the frames are displayed. It also allows the pre-processing parameters to be adapted more smoothly so that sudden processing changes don't occur and cause visible artefacts (such as sudden colour or brightness changes) for the side viewer.

Although step 102 of FIG. 1 is shown and described above as being carried out as a separate step before the combination step 104, it is also possible that at least some of the processing performed in step 102 is carried out as part of the combination step 104. For example, GB2457106A describes the use of a lookup table (LUT) to perform the combination (or mapping) of the main image data and the side image data, and it will be apparent that at least part of the processing carried out in step 102 above can be incorporated into the LUT itself. For example, the contrast enhancement carried out by the contrast enhancer 204, in which the tonal range is stretched, could effectively be done by the LUT mapping rather than as a separate step in advance of the LUT mapping. This would be particularly feasible in an implementation where the side image that is passed to the combination step 104 (LUT mapping) retains a relatively high bit depth. In an implementation where account is taken of image content to guide step 102, a plurality of different LUTs could be provided, one of which would be selected based on a classification of image content; for example different LUTs might be provided for "high contrast original", "low contrast original", and "medium contrast original", each incorporating a different level of contrast enhancement. As an alternative, one could repopulate the LUT mapping based on the image content, although this would be more computationally intensive.

It will be appreciated that an embodiment of the present invention can be applied to privacy and multi-view displays other that those mentioned above, and particularly displays other than those described in GB2457106A.

It will be appreciated that, although it is normal to provide a display device which is capable of operating in both public and private modes and switchable between the two modes, the present invention is applicable to display devices capable of operating only in the private mode.

It will be appreciated that operation of one or more of the above-described components can be controlled by a program operating on the device or apparatus. Such an operating program can be stored on a computer-readable medium, or could, for example, be embodied in a signal such as a downloadable data signal provided from an Internet website.

Some embodiments of the present invention disclose methods in which the second processing step may comprise a sub-step for each of a plurality of features of the side image being emphasised.

Some embodiments of the present invention disclose methods, which may comprise performing first and second sets of sub-steps in first and second different respective colour spaces, where each set comprises one or more sub-steps.

Some embodiments of the present invention disclose methods, which may comprise, in a third processing step, spatially resampling the side image in order to provide the required number of pixels in the correct aspect ratio for the first processing step.

Some embodiments of the present invention disclose methods in which the third processing step may be performed before the second processing step.

Some embodiments of the present invention disclose methods in which the third processing step may be performed between two of the sub-steps.

Some embodiments of the present invention disclose methods, which may comprise performing a colour quantisation step to reduce the bit depth of each colour component of the side image to the bit depth required for the first processing step.

Some embodiments of the present invention disclose methods, which may comprise, for each pixel of the side image, choosing the nearest available colour in the reduced bit depth colour space, there being an associated colour error in doing so, and preferably taking account of the or each colour error from at least one nearby pixel.

Some embodiments of the present invention disclose methods in which the at least one feature may include the tonal and/or spatial contrast of at least part of the side image, at least within a predetermined tonal or data value range.

Some embodiments of the present invention disclose methods in which the contrast outside the predetermined tonal or data range may be reduced, for example to zero.

Some embodiments of the present invention disclose methods in which the at least one feature may include the saturation and/or colour of at least part of the side image, at least within a predetermined saturation range.

Some embodiments of the present invention disclose methods in which the predetermined range may be a mid range, for example from 20% to 80% of the entire range.

Some embodiments of the present invention disclose methods in which the side image pixel data within a range of human skin tones may be processed differently to side image pixel data outside the range of human skin tones.

Some embodiments of the present invention disclose methods in which the at least one feature may include at least one spatial feature of the side image.

Some embodiments of the present invention disclose methods in which the at least one spatial feature may comprise an edge feature.

Some embodiments of the present invention disclose methods in which the second processing step may comprise applying an unsharp mask filter to the side image.

Some embodiments of the present invention disclose methods in which the second processing step may comprise applying a bilinear filter or other spatial filter which uses pixel data of pixels within the filter area to adjust weightings in the filter.

Some embodiments of the present invention disclose methods in which the at least one feature may be emphasised at the expense of at least one other feature, the at least one other feature for example being considered to be of lesser visual importance. For example, mid-range contrast may be enhanced at the expense of contrast towards the lower and higher tonal ends of the range.

Some embodiments of the present invention disclose methods, which may comprise processing different portions of the side image differently.

Some embodiments of the present invention disclose methods, which may comprise processing text portions differently to non-text portions.

Some embodiments of the present invention disclose methods, which may comprise rendering text in a specially selected font different to that used in the side image.

Some embodiments of the present invention disclose methods, which may comprise processing one or more portions of the side image identified as containing a principal subject of the side image differently to other portions of the side image.

Some embodiments of the present invention disclose methods, which may comprise taking account of the main image pixel data in the processing of the side image pixel data in the second processing step.

Some embodiments of the present invention disclose methods in which at least part of the second processing step may be performed off-line.

Some embodiments of the present invention disclose methods in which the entire second processing step may be performed on-line.

Some embodiments of the present invention disclose methods in which at least one of the sub-steps may be performed on-line and at least one other of the sub-steps may be performed off-line.

Some embodiments of the present invention disclose methods in which the at least one feature may be emphasised in the second processing step to an extent at least as great as the extent to which the at least one feature is perceived as being de-emphasised in the side image displayed off axis as a result of the first processing step.

Some embodiments of the present invention disclose methods in which the at least one feature may be emphasised in the second processing step at least to compensate for the perceived de-emphasis in the side image displayed off axis as a result of the first processing step.

Some embodiments of the present invention disclose methods in which the at least one feature may be emphasised in the second processing step to an extent that is greater than would normally be considered appropriate for an image without the perceived de-emphasis in the side image displayed off axis as a result of from the first processing step.

Some embodiments of the present invention disclose methods in which the second processing step may comprise de-emphasising at least one further feature of the side image which would detract from a better side image as seen by the off-axis viewer.

Some embodiments of the present invention disclose methods in which a time sequence of main and side images may be presented, and the second processing step may use side image pixel data from a plurality of side images in the sequence.

Some embodiments of the present invention disclose methods in which at least part of the second processing step may be incorporated into the mapping performed in the first processing step. The second processing step is performed either before the first processing step or is at least partly incorporated into the mapping performed in the first processing step.

Some embodiments of the present invention disclose methods in which the second processing step may also comprise processing the pixel data of the main image in order to emphasise at least one feature of the main image which might otherwise be perceived by a viewer as being de-emphasised in the main image displayed on axis as a result of the first processing step.

Some embodiments of the present invention disclose an apparatus programmed by a program for controlling an apparatus to perform a method according to the above described methods or which, when loaded into an apparatus, causes the apparatus to become an apparatus or device according to the above described apparatus or devices of the present invention. The program may be carried on a carrier medium. The carrier medium may be a storage medium. The carrier medium may be a transmission medium.

Some embodiments of the present invention disclose a storage medium containing a program for controlling an apparatus to perform a method according to the above described methods or which, when loaded into an apparatus, causes the apparatus to become an apparatus or device according to the above described apparatus or devices of the present invention. The program may be carried on a carrier medium. The carrier medium may be a storage medium. The carrier medium may be a transmission medium.

The appended claims are to be interpreted as covering an operating program by itself, or as a record on a carrier, or as a signal, or in any other form. In addition, any figure which shows a set of functions or steps should be interpreted as also showing a corresponding set of parts for performing those respective functions or steps, and likewise any figure which shows a set of parts for performing respective functions or steps should be interpreted as also showing a corresponding set of functions or steps.

The invention claimed is:

1. A method of processing image data for display by a display panel of a display device, wherein the display device comprises pixels all having substantially the same angular transmission properties, the method comprising:

receiving main image pixel data representing a main image and side image pixel data representing a side image;

in a first processing step, performing a mapping of the pixel data to signals used to drive the display panel, wherein the mapping is arranged to produce an average on-axis luminance which is dependent mainly on the main image pixel data and an average off-axis luminance which is dependent at least to some extent on the side image pixel data;

in a second processing step, processing the received side image pixel data in order to emphasise at least one feature of the side image which might otherwise be perceived by a viewer as being de-emphasised in the side image displayed off axis as a result of the first processing step; and in a third processing step, spatially resampling the side image in order to provide the required number of pixels in the correct aspect ratio for the first processing step.

2. A method as claimed in claim 1, wherein the second processing step comprises a sub-step for each of a plurality of features of the side image being emphasised.

3. A method as claimed in claim 2, comprising performing first and second sets of sub-steps in first and second different respective colour spaces, where each set comprises one or more sub-steps.

4. A method as claimed in claim 1, wherein the third processing step is performed before the second processing step.

5. A method as claimed in claim 2, wherein the third processing step is performed between two of the sub-steps.

6. A method of processing image data for display by a display panel of a display device, wherein the display device comprises pixels all having substantially the same angular transmission properties, the method comprising:

receiving main image pixel data representing a main image and side image pixel data representing a side image;

in a first processing step, performing a mapping of the pixel data to signals used to drive the display panel, wherein the mapping is arranged to produce an average on-axis luminance which is dependent mainly on the main image pixel data and an average off-axis luminance which is dependent at least to some extent on the side image pixel data:

in a second processing step, processing the received side image pixel data in order to emphasise at least one feature of the side image which might otherwise be perceived by a viewer as being de-emphasised in the side image displayed off axis as a result of the first processing step; and performing a colour quantisation step to reduce the bit depth of each colour component of the side image to the bit depth required for the first processing step, wherein for each pixel of the side image, choosing the nearest available colour in the reduced bit depth colour space, there being an associated colour error in doing so, and preferably taking account of the or each colour error from at least one nearby pixel.

7. A method of processing image data for display by a display panel of a display device, wherein the display device comprises pixels all having substantially the same angular transmission properties, the method comprising:

receiving main image pixel data representing a main image and side image pixel data representing a side image;

in a first processing step, performing a mapping of the pixel data to signals used to drive the display panel, wherein the mapping is arranged to produce an average on-axis luminance which is dependent mainly on the main image pixel data and an average off-axis luminance which is dependent at least to some extent on the side image pixel data; and in a second processing step, processing the received side image pixel data in order to emphasise at least one feature of the side image which might otherwise be perceived by a viewer as being de-emphasised in the side image displayed off axis as a result of the first processing step;

wherein the at least one feature includes the tonal and/or spatial contrast of at least part of the side image, at least within a predetermined tonal or data value range and the contrast outside the predetermined tonal or data range is reduced.

8. A method as claimed in claim 7, wherein the contrast outside the predetermined tonal or data range is reduced to zero.

9. A method as claimed in claim 1, wherein the at least one feature includes the saturation and/or colour of at least part of the side image, at least within a predetermined saturation range.

10. A method as claimed in claim 7, wherein the predetermined range is a mid range, for example from 20% to 80% of the entire range.

11. A method as claimed in claim 1, wherein side image pixel data within a range of human skin tones are processed differently to side image pixel data outside the range of human skin tones.

12. A method as claimed in claim 1, wherein the at least one feature includes at least one spatial feature of the side image.

13. A method as claimed in claim 12, wherein the at least one spatial feature comprises an edge feature.

14. A method as claimed in claim 13, wherein the second processing step comprises applying an unsharp mask filter to the side image.

15. A method as claimed in claim 1, wherein the second processing step comprises applying a bilinear filter or other spatial filter which uses pixel data of pixels within the filter area to adjust weightings in the filter.

16. A method as claimed in claim 1, wherein the at least one feature is emphasised at the expense of at least one other feature, the at least one other feature for example being considered to be of lesser visual importance.

17. A method as claimed in claim 1, comprising processing different portions of the side image differently.

18. A method as claimed in claim 17, comprising processing text portions differently to non-text portions.

19. A method as claimed in claim 18, comprising rendering text in a specially selected font different to that used in the side image.

20. A method as claimed in claim 17, comprising processing one or more portions of the side image identified as containing a principal subject of the side image differently to other portions of the side image.

21. A method as claimed in claim 1, comprising taking account of the main image pixel data in the processing of the side image pixel data in the second processing step.

22. A method as claimed in claim 1, wherein at least part of the second processing step is performed off-line.

23. A method as claimed in claim 1, wherein the second processing step is performed on-line.

24. A method as claimed in claim 2, wherein at least one of the sub-steps is performed on-line and at least one other of the sub-steps is performed off-line.

25. A method as claimed in claim 1, wherein the at least one feature is emphasised in the second processing step to an extent at least as great as the extent to which the at least one feature is perceived as being de-emphasised in the side image displayed off axis as a result of the first processing step.

26. A method as claimed in claim 1, wherein the at least one feature is emphasised in the second processing step at least to compensate for the perceived de-emphasis in the side image displayed off axis as a result of the first processing step.

27. A method as claimed in claim 1, wherein the at least one feature is emphasised in the second processing step to an extent that is greater than would normally be considered appropriate for an image without the perceived de-emphasis in the side image displayed off axis as a result of from the first processing step.

28. A method as claimed in claim 1, wherein the second processing step comprises de-emphasising at least one further feature of the side image which would detract from a better side image as seen by the off-axis viewer.

29. A method as claimed in claim 1, wherein a time sequence of main and side images is presented, and wherein the second processing step uses side image pixel data from a plurality of side images in the sequence.

30. A method as claimed in claim 1, wherein at least part of the second processing step is incorporated into the mapping performed in the first processing step.

31. A method as claimed in claim 1, wherein the second processing step also comprises processing the pixel data of the main image in order to emphasise at least one feature of the main image which might otherwise be perceived by a viewer as being de-emphasised in the main image displayed on axis as a result of the first processing step.

32. An apparatus arranged to perform a method as claimed in claim 1.

33. A display device comprising an apparatus as claimed in claim 32.

* * * * *